US007474263B1

(12) United States Patent
Garfinkle et al.

(10) Patent No.: US 7,474,263 B1
(45) Date of Patent: Jan. 6, 2009

(54) ELECTRONICALLY SCANNED ANTENNA

(75) Inventors: Robert J. Garfinkle, Yorba Linda, CA (US); Joseph E. Wheeler, Plano, CA (US); Donald R. Wells, Long Beach, CA (US); Jar J. Lee, Irvine, CA (US); Richard P. Ritch, Tarzana, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/981,183

(22) Filed: Oct. 31, 2007

(51) Int. Cl.
*H01Q 3/00* (2006.01)

(52) U.S. Cl. ..... 342/373; 342/372; 342/374

(58) Field of Classification Search ..... 342/368, 342/371–374, 81, 154
See application file for complete search history.

(56) References Cited

U.S. PATENT DOCUMENTS 3,993,999 A * 11/1976 Hemmi et al. ..... 342/372
4,070,678 A * 1/1978 Smedes ..... 343/754
4,381,509 A * 4/1983 Rotman et al. ..... 343/754
4,812,788 A 3/1989 Wong et al.
5,283,587 A * 2/1994 Hirshfield et al. ..... 342/372
5,874,915 A 2/1999 Lee et al.
6,268,835 B1 * 7/2001 Toland et al. ..... 343/781 P
6,404,377 B1 6/2002 Lee et al.
6,781,554 B2 8/2004 Lee et al.
2003/0134592 A1 * 7/2003 Franzen et al. ..... 455/12.1

OTHER PUBLICATIONS

K.M. Lee et al., "Design and Analysis of a Multimode Feed Horn for a Monopulse Feed," IEEE Transactions on Antennas and Propagation, vol. 36, No. 2, pp. 171-181, Feb. 1988.
Peter W. Hannan, "Optimum Feeds for All Three Modes of a Monopulse Antenna I: Theory," IRE Transactions on Antennas and Propagation, pp. 444-454, Sep. 1961.
Peter W. Hannan, "Optimum Feeds for All Three Modes of a Monopulse Antenna II: Practice," IRE Transactions on Antennas and Propagation, pp. 454-461, Sep. 1961.

* cited by examiner

*Primary Examiner*—Dao L Phan
(74) *Attorney, Agent, or Firm*—Leonard A. Alkov

(57) ABSTRACT

An electronically scanned antenna may include a plurality of space-fed, contiguous subarrays arranged in an annular region, each subarray including an inner set of radiating elements facing inwardly, an outer-facing set of radiating elements, and a feed system for illuminating the inner set of radiating elements. A plurality of RF amplifiers are coupled through a commutation switch matrix to selected ones of the subarray feed horn systems to illuminate a desired sector with RF energy.

21 Claims, 6 Drawing Sheets

FIG.4A
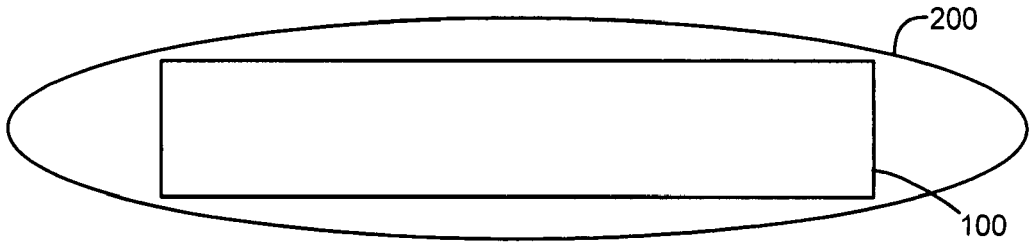
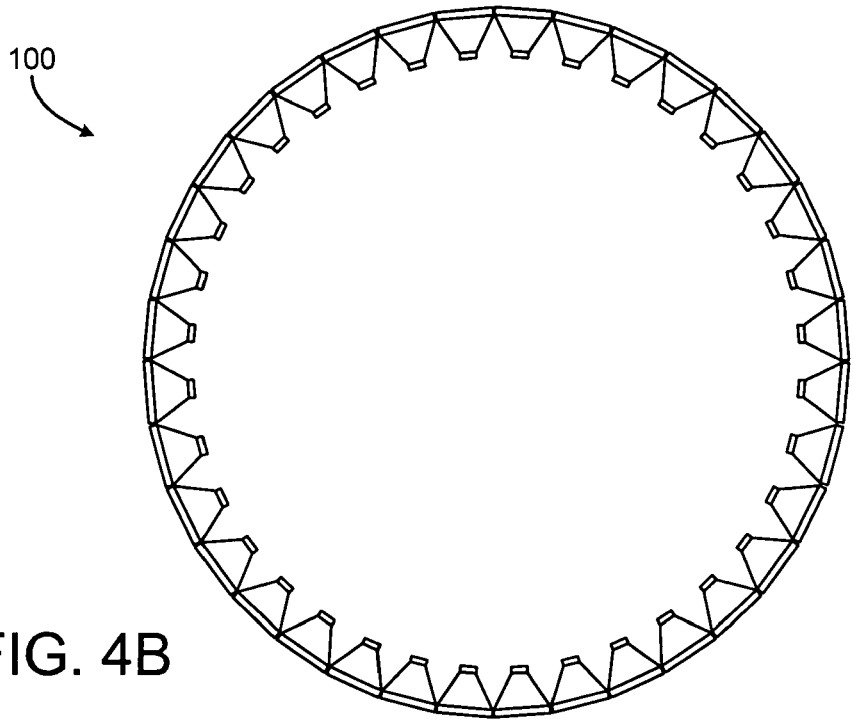
FIG. 4B

ELECTRONICALLY SCANNED ANTENNA

BACKGROUND

Most conventional phased arrays use corporate feeds to distribute transmit (Tx) power to the radiating elements. However, for a high power large circular array, the corporate feed network would be complex, lossy, and costly to build.

SUMMARY OF THE DISCLOSURE

An electronically scanned antenna includes a plurality of space-fed, contiguous subarrays arranged in an annular region. Each subarray includes an inner set of radiating elements facing inwardly, an outer-facing set of radiating elements, and a feed horn system for illuminating the inner set of radiating elements. A plurality of high power RF amplifiers are coupled through a commutation switch matrix to selected ones of the subarray feed horn systems to illuminate a desired sector with RF energy.

BRIEF DESCRIPTION OF THE DRAWINGS

FIG. 4A is a diagrammatic side view depiction of an exemplary embodiment of a circular antenna array. FIG. 4B is a schematic top view depiction of the outer subarray configuration of the exemplary embodiment of FIG. 4A.

DETAILED DESCRIPTION

Figure 1:
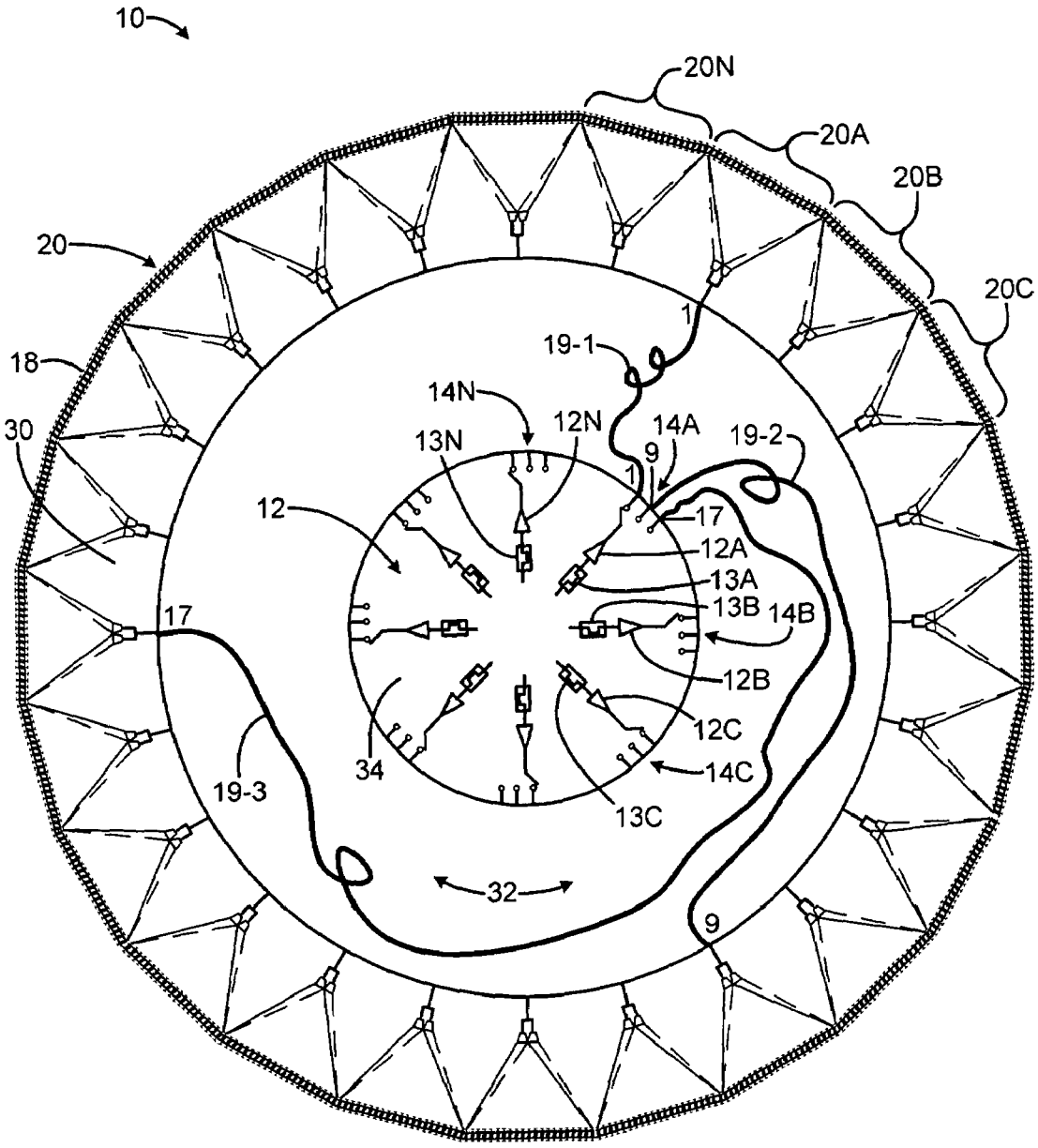
FIG. 1 is a simplified schematic diagram of an exemplary embodiment of an antenna aperture.

In the following detailed description and in the several figures of the drawing, like elements are identified with like reference numerals. The figures are not to scale, and relative feature sizes may be exaggerated for illustrative purposes.

An exemplary embodiment of an array may, in an exemplary application, be employed to provide 360 degree airborne surveillance radar coverage. It is to be understood that this is an exemplary application, and that an array as described herein may be utilized in other applications.

FIG. 1 is a top view of an exemplary embodiment of an antenna array 10. The exemplary array embodiment may include a central bank 12 of high power amplifiers (HPAs) 12A, 12B, 12C . . . 12N which can be switched on a beam-to-beam basis to illuminate a desired sector. Switches 14A-14N may form a commutating switch matrix for this purpose. Radiating elements 18 are disposed about the periphery of the array aperture, e.g. in this case in a generally circular or cylindrical pattern. A collection of subarrays of the set 20 of space-fed subarrays 20A, 20B, 20C . . . 20N for the desired sector may provide fine grain beam steering control to form individual transmit and receive beams, and, in the case of a monopulse implementation, sum and difference monopulse receive beams. Each subarray includes a collection of the radiating elements 18. In an exemplary embodiment, receive beam forming may be accomplished digitally after each receive channel is down converted and digitally converted.

In an exemplary embodiment, an interior annular region 32 lies generally between the interior region 34 and the annulus 30. The interior annular region provides space for a cable assembly for power distribution between the subarrays disposed on the outer annular region 30 and the high power sources 12A-12N disposed in the inner region 34. The cable assembly may include cables 19-1, 19-2, 19-3 connected between the exemplary three-way switch 14A and respective ones of the sub-arrays marked 1, 9 and 17 of the 24 sub-arrays in the exemplary array depicted in FIG. 1. The cables may be equal length in some embodiments, although in other embodiments, the equalization of the cable lengths may not be employed. Delay lines 13A-13N may be employed to connect the HPAs to an exciter (not shown in FIG. 1), e.g. to increase the bandwidth, although for some applications the delay lines may be omitted.

In an exemplary embodiment, the subarrays 20 may be arranged in a generally circular pattern on an annulus 30, as depicted in FIG. 1, forming a circular or cylindrical array. A suitable grouping of several subarrays may form beams in a selected sector of the compass. Radar beams may be formed in a given sector and subarray phase shifters may be adjusted to provide electronic beam steering in azimuth and elevation within that sector.

Figure 2:
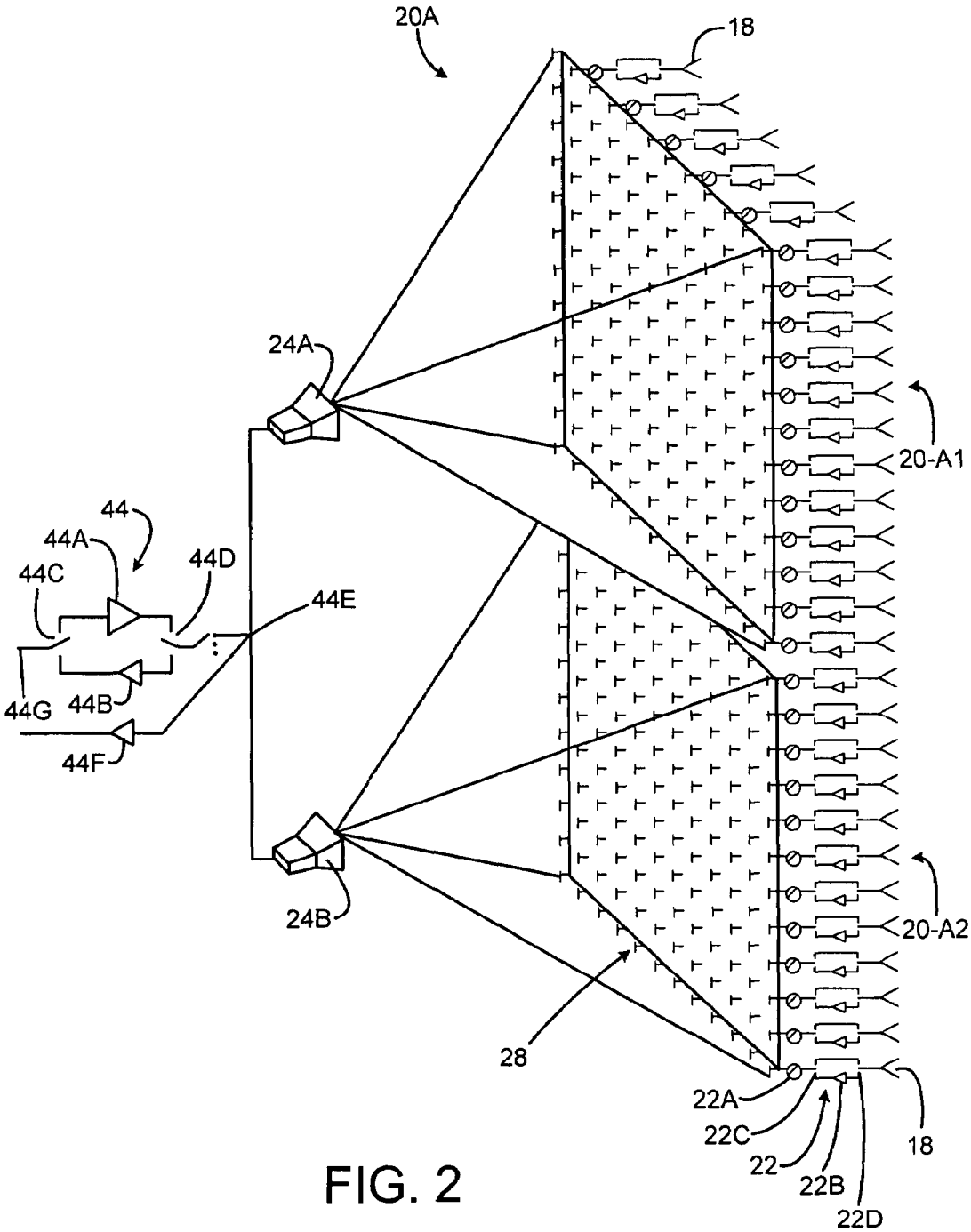
FIG. 2 is a schematic diagram illustrating an exemplary embodiment of a single sub array with two panels of radiating elements.

In an exemplary embodiment, the high power generation and distribution system may be separated from that of the low power system including LNA and digital beam control electronics. This may be accomplished in a feed-through lens array system, where the phased array includes two facets, one facing the RF space feed illuminator and the other radiating into the free space. An exemplary embodiment is depicted in FIG. 2, wherein pickup elements 28 face a space feed illuminator horn, and radiating elements 18 radiate into free space, FIG. 2 is an isometric diagrammatic view illustrating an exemplary subarray 20A for providing an exemplary elevation monopulse function. The subarray includes the radiating elements 18 arranged in a spaced configuration, e.g., wherein the radiating elements are nominally spaced by 0.6 wavelength at an operating frequency, which are each connected through a T/R module 22 to a corresponding pickup element 28. In an exemplary embodiment, the pickup elements 28 may include vertically polarized dipole elements. Transmit/receive (T/R) modules 22 including phase shifters may be located on each element of the subarray. The T/R modules 22 in an exemplary embodiment function to isolate the transmit and receive signals and provide low noise amplifiers (LNAs) 22B for the received signals as well as variable phase shifters 22A for beam steering. A set of transfer switches 22C, 22D in each T/R module select a transmit channel through the module or a receive channel through the LNA. In an exemplary embodiment, the switches 22C, 22D may be double-pole, double-throw switches. In an exemplary embodiment, high power amplifiers are not part of the T/R modules 22.

The subarray pickup elements 28 are illuminated by an RF power source, which may be a feed horn system in an exemplary embodiment, within the annulus 30. The exemplary embodiment of the subarray 20A depicted in FIG. 2 is a split array, comprising split subarrays 20-A1 and 20-A2 arranged vertically to provide an elevation plane height of 24 radiating elements 18. In this embodiment, each split subarray includes a 12 element by 12 element array of radiating elements 18 and associated T/R modules 22 and pick-up elements 28. The split subarray configuration may provide the capability of monopulse operation.

In an exemplary embodiment, the subarray feed system includes a feed horn system for illuminating the pickup elements 28 of each subarray. In the case of a split subarray configuration as depicted in FIG. 2, a separate feed horn may be provided for each split subarray. Thus, an upper feed horn 24A feeds the upper split subarray 20-A1, and horn 24B feeds the lower split subarray 20A-2. The feed horns in turn are connected to side arm ports of a Magic-T coupler 44E. The sum port of the coupler is connected through a 1:3 switch to a T/R module 44, and the difference port is connected to amplifier 44F and then through a transmission line, e.g. an optical fiber in one embodiment, to a receiver for processing a monopulse difference signal. The T/R module includes a high power transmit amplifier 44A, a receive amplifier 44F, switches 44C, 44D for selecting either the transmit channel through amplifier 44A or the receive channel through amplifier 44F. The I/O port 44G of the T/R module may be connected to a radar exciter and sum receiver. The amplifier 44A may function as one of the high power amplifiers 12A-12N in the embodiment of FIG. 1, connected through the 1:3 switch which may serve as one of the switches 14A-14N of FIG. 1.

In an exemplary embodiment, the subarray feed system lends itself to a stationary circular array which may be capable of directing a beam in any azimuth direction by switching the power to any azimuth sector and providing for electronic beam steering within that sector. Scanning in elevation may also be possible with this implementation and split subarrays in elevation may provide for sum and difference beams for monopulse operation. In an exemplary embodiment, the RF source, e.g. amplifier 12A-12N (FIG. 1) or 44A (FIG. 2), for each subarray may be derived from a "bottle" such as a TWTA or solid state HPA having a total average power in the range of several hundred watts for this application. Additionally, space time adaptive processing may be performed by weighting and combining the returns from each subarray.

An exemplary antenna configuration depicted in FIG. 1 includes a circular array of subarrays arranged on an annulus. A contiguous group of subarrays may be excited by illumination from behind the subarrays wherein each subarray may be illuminated by a single horn, or, in the case of a monopulse application involving split arrays, two or four feed horns. This is commonly referred to as "space fed illumination". The subarrays are then phased by control of the phase shifters 22A (FIG. 2) of the respective subarray T/R modules 22 to form a directed beam in the far field. Phase shifters 22A may be located on each element in the subarrays to provide beam steering in azimuth and elevation. In this way electronic beam steering may be provided in an exemplary embodiment for the full 360 degrees field in azimuth and for a limited field in elevation.

Most conventional phased arrays use corporate feed networks to distribute transmit (Tx) power to the radiating elements. However, for a high power large circular array, the corporate feed network may be complex, lossy, and costly to build. In an exemplary embodiment, a hybrid approach is described in which the transmit power and received signals may be distributed to a number of subarrays through a commutation switch matrix. As described above, within each subarray the transmitter power is fed to the radiating elements from a space fed source, which may reduce RF losses and system cost. This exemplary embodiment may provide an S-band radar suitable for airborne search and track applications; the subject matter applies to other radar operating frequency bands, such as L, C, X, K or W Bands.

In an exemplary embodiment, the transmit power may be distributed to a selected active sector of the circular array (each sector includes ⅓ of the radiating elements in this example) through a commutation switch matrix, so that only a small number of high power amplifiers may be employed. The reason for this approach is that only a fraction of the circular array may be needed to form a beam for any given direction in the 360 degree azimuth plane. The exemplary array embodiment illustrated in FIG. 1 includes 24 subarrays arranged in a circular configuration, with 8 HPAs coupled to the subarrays through a commutation switch matrix including 8 switches 14A-14N. Each switch may connect a given HPA to one of three subarrays 20A-20N. Thus, in this example, 8 of the subarrays may be connected to an HPA; the selection of the subarrays will select the particular sector to be illuminated for a given beam.

An exemplary embodiment of a space-fed circular ESA for S-band operation may include 36 subarrays around a circle approximately 20 ft in diameter. Each subarray in turn may include 12 vertical columns with 288 elements in which each vertical column is grouped into two panels or split subarrays of 144 elements each, as shown in FIG. 2. The top and bottom panels, for example, panels 20A-1 and 20A-2 shown in FIG. 2, may be used to form sum and difference beams in the elevation plane on receive. In addition to the phase shifter 22A and double-pole, double-throw switches 22C, 22D, each T/R module 22 may include an LNA (low noise amplifier) 22B to reduce the system noise figure on receive. On transmit, the RF power is supplied by the feed horns, e.g. 24A, 24B in FIG. 2, located at an appropriate distance from the subarray pickup elements 28 with an f/D (focus/distance) of 0.5 or less. In an exemplary embodiment, the design may be optimized to ensure that the spillover and the taper losses over the subarray are not excessive, a practice known to engineers skilled in the art of antenna design and common to reflector antenna design.

An exemplary embodiment of a circular ESA may utilize approximately ⅓ of the entire array to form beams in a particular direction or "sector". It is to be understood, however, that any fraction of the entire array may alternatively be employed in forming a sector. For example, fewer than ⅓ of the array or as many as ½ of the array may be employed in a sector.

Figure 3B:
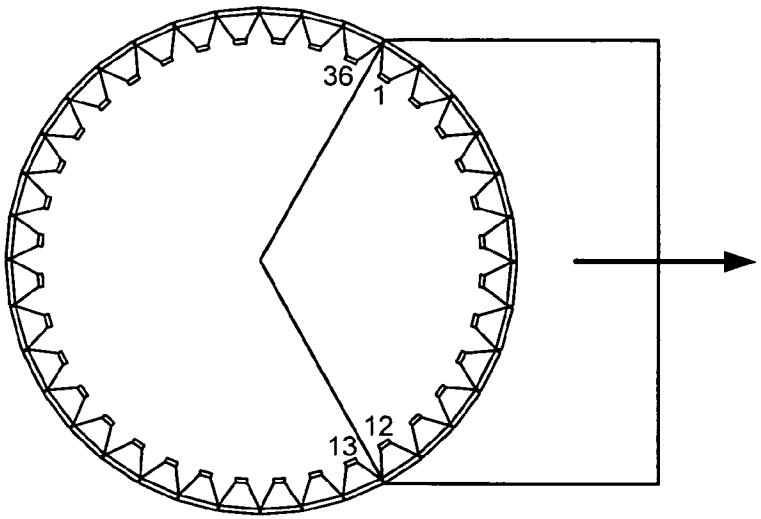
FIG. 3B is a diagrammatic illustration of a beam formed by an exemplary setting of the feed network of FIG. 3A.
Figure 3A:
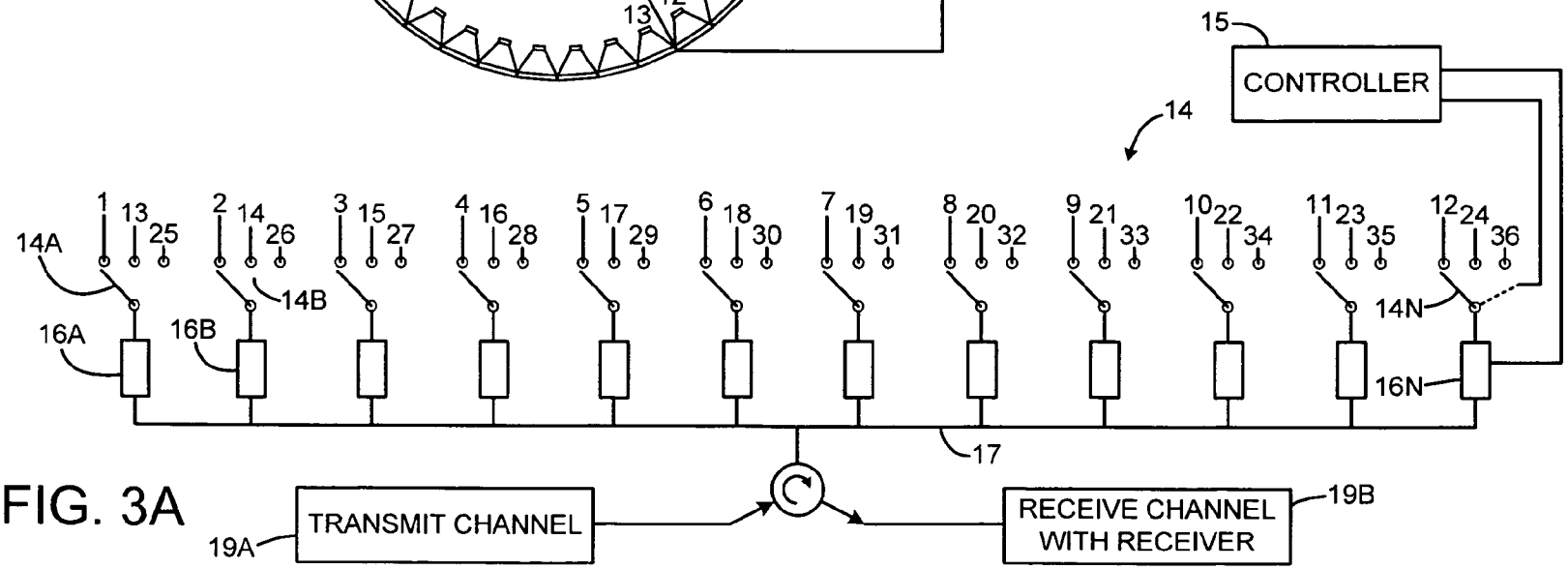
FIG. 3A is a schematic diagram of an exemplary commutating sectorial feed network.

FIGS. 3A-3B schematically illustrate an exemplary embodiment of a commutating switch matrix 14 for performing beam sector switching of an array comprising sub arrays 1-36 (depicted in FIG. 3B). This exemplary embodiment uses a circular array for 360 degree azimuth coverage. 12 high power amplifier and receive modules 16A-16N are connected to respective ones of the switches 14A-14N of the switch matrix. A power divider 17 connects the modules 16A-16N to transmit and receive channels 19A, 19B. The switches and modules 16A-16N are controlled by controller 15.

Each switch 14A-14N is a two-pole switch having three ways, which may connect a module to one of three sub arrays. For example, switch 14A is adapted to connect module 16A to one of sub arrays 1, 13 and 25, switch 14B to connect module 16B to one of sub arrays 2, 14, 26, and switch 14N to connect module 16N to one of sub arrays 12, 24, 36. In the switch position illustrated in FIG. 3A, sub arrays 1-12 are connected to the modules, to form a beam as illustrated in FIG. 3B. The switches 14A-14N may be implemented, for example, by mechanical switches, PIN diode switches, ferrite switches, or 4/4 butler matrices, with a phase shifter on each input to select one output.

With a sector including ⅓ of the full 360 degrees field of view, the number of switches 14A-14N remains equal to ⅓ of the total number of azimuth subarrays for transmit and an equal number for receive. This may be implemented by employing two pole switches having three directions (ways) each. As the number of desired sector directions is increased, the number of subarrays to be switched to move to an adjacent direction is reduced accordingly. With 12 switches, 36 sector directions can be chosen in this example. The smallest incremental direction change may be accomplished by moving an end subarray to its opposite position in the beam forming subarray which is one of three positions available on its switch. A controller 15 may be employed to select the correct switches to choose a beam direction and all the phase shifters may be reset to form the desired beam. Of course, the largest possible number of sector directions is equal to the number of subarrays (36 in this example).

In an exemplary embodiment, the beam may be repositioned to any sector in the 360 degree azimuth field of view. If a smaller range of electronic beam steering is permitted in each of the nominal directions, more sector directions can be chosen and fewer switches need to be thrown to move the beam by one step. Distant targets only need a small field of view for tracking, and switching by small sectors would normally be adequate. Beam steering by phase control rather than switching among adjacent beams may avoid the noise induced by a scalloped antenna pattern.

FIG. 4A is a diagrammatic side view depiction of a form factor for an exemplary embodiment of a circular antenna array. FIG. 4B is a schematic top view depiction of the outer subarray configuration of the exemplary embodiment of FIG. 4A. The antenna array 150 may fit within a radome structure 200. The array may include 36 sub arrays arranged in a circular array configuration, with a 21 foot diameter, and a height of 4 feet. The radome structure may have an outer diameter of 30 feet in this exemplary embodiment.

Figure 5:
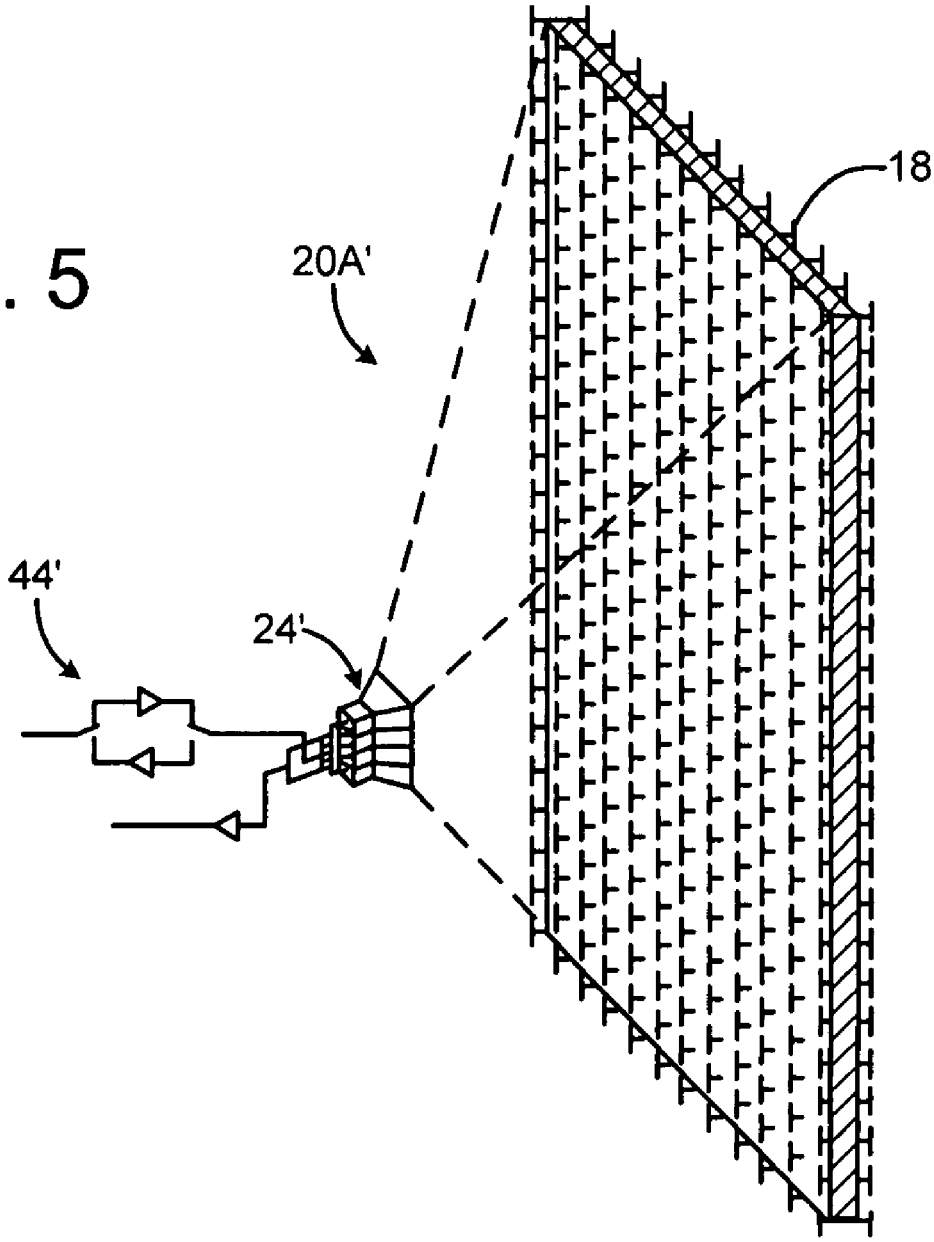
FIG. 5 is a schematic diagram illustrating an exemplary embodiment of a sub array with a panel of radiating elements.

FIG. 5 depict an alternate embodiment of a sub array 20A', which may be incorporated in a circular array as depicted in FIG. 1 or FIG. 3, for example. The sub array 20A' may be generally similar to the sub array panels depicted in FIG. 2, except that a single panel is used, in combination with a feed horn assembly incorporated in system 44'. A suitable feed horn is described in "Design and Analysis of a Multimode Feed Horn for a Monopulse Feed," Lee et al., IEEE Transactions on Antennas and Propagations, Vol. 36, No. 2, February 1988, pages 171-181.

Figure 6B:
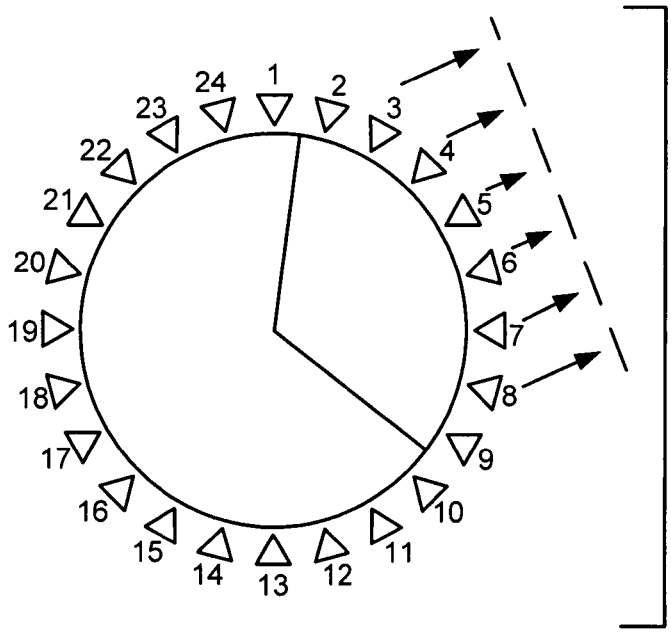
FIG. 6B depicts an exemplary beam formed from a circular array with the switch arrangement of FIG. 6A.
Figure 6A:
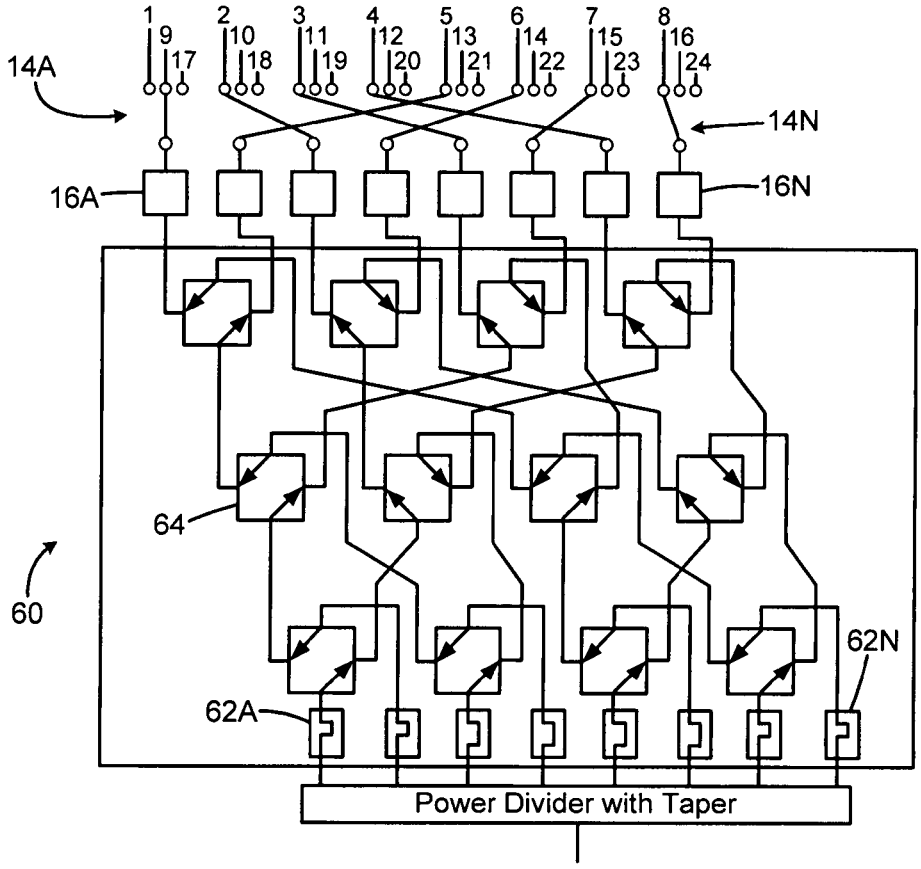
FIG. 6A is a schematic of an exemplary embodiment of a commutation switch network which includes a transfer switch matrix to correct the fixed time delays associated with the circular arc

FIG. 6A is a schematic of an exemplary embodiment of a commutation switch network 14A-14N which includes an optional transfer switch matrix 60 to correct the fixed time delays associated with the circular arc, to provide a beam from a circular array depicted in FIG. 6B. In this example there are 24 beam positions in total with 15° step as the beam is switched around the azimuth plane using the commutation scheme. Refined beam scanning within the limited scan region may be accomplished by the phase shifters in the subarrays. If a wider bandwidth is desired, a time delay feed network 62A-62N may be included. For a wide bandwidth exemplary application, these delay lines may be fixed and common to all beam positions. In conjunction with the 1:3 commutation switches 14A-14N at the output, the (8×8) transfer switch matrix 60 correspondingly maps these delay lines into the 24 elements on the circle to equalize the differential time delays for a given beam direction. In conjunction with the 1:3 commutation switches at the output, the (8×8) transfer switch matrix with switches 64 correspondingly maps these delay lines into the 24 elements on the circle to equalize the differential time delays for a given beam direction. It is to be understood that the configuration shown in FIG. 6A is illustrative only and the concept can be applied to a circular array of any number of sub arrays.

Exemplary embodiments may include one or more of the following features.

1. A flexible circular phased array antenna, including a non-rotating, circular, electronically scanned array (ESA) may provide 360 degree coverage in the azimuth plane, e.g., for airborne radar applications. A hybrid feed approach may be employed in which the transmit power and received signals are distributed to a number of subarrays through a commutation switch matrix. Within each subarray the transmitter power is fed to the radiating elements with a space feed to reduce RF loss and system cost.

2. RF power distribution may be achieved by locating the high power transmit amplifiers at a central location close to the array where cooling and power can conveniently be made available. At the same time light weight low noise receiver modules may be located on every element of the array to boost the received signal before incurring any further network losses. Locating the transmitter modules in a central but nearby location may result in only a small loss passing through cabling and switches. Light weight receiver modules can be located on every element thereby improving signal to noise ratio, while a smaller number of heavier transmitter modules may be conveniently centrally located where power and cooling can be more readily supplied with only a small power loss through the cabling and switches.

3. A method may be provided for feeding elements of a circular phased array antenna that rotates the beam around a 360 degree field of view by switching groups of elements. The method allows rotation of a circular array in steps as small as permitted by the number of subarrays around a circular array in a switching operation followed by electronic beam steering within each sector. A commutating switch architecture may also support beam switching from any beam position within the 360° antenna field of regard to any other beam position at a search or track update dwell rate. This architecture also may also support active array processing including elevation and azimuth monopulse.

4. Large Bandwidth Switching. A commutation switch network may include an optional transfer switch matrix to correct the fixed time delays associated with the circular arc. Refined beam scanning within the limited scan region may be accomplished by the phase shifters in the subarrays. If a wider bandwidth is desired, a time delay feed network may be included and for the wide bandwidth application, these delay lines may be fixed and common to all beam positions.

Although the foregoing has been a description and illustration of specific embodiments of the invention, various modifications and changes thereto can be made by persons skilled in the art without departing from the scope and spirit of the subject matter as defined by the following claims.

What is claimed is:

1. An electronically scanned array (ESA) comprising:

a set of space-fed, contiguous subarrays arranged in an annular region about a generally circular aperture, each subarray including an inner set of radiating elements facing inwardly, an outer-facing set of radiating elements, and a feed horn system for illuminating the inner set of radiating elements;

a set of high power RF amplifiers; and a commutation switch matrix for coupling outputs of the high power amplifiers to selected ones of the subarray feed horn systems to illuminate a desired sector with RF energy, and wherein the switch matrix is controllable to select different sets of the subarray feed horn systems to illuminate a plurality of different sectors in dependence on switch settings.

2. The ESA of claim 1, wherein the subarrays are non-rotating, and the ESA over said plurality of different sectors provides 360 degree coverage in an azimuth plane.

3. The ESA of claim 1, wherein the plurality of subarrays further includes, for each outer-facing radiating element, a transmit/receive (T/R) module including a phase shifter, a transmit channel and a receive channel including a low noise amplifier.

4. The ESA of claim 1, wherein the commutation switch matrix includes a set of two pole, M-way switches, and each switch selectively connects one of said RF amplifiers to one of M subarrays.

5. The ESA of claim 4, further comprising a set of cables, wherein each cable of said set is connected between an output of one of said switches and one of said subarrays.

6. The ESA of claim 1, wherein each sector is a 120 degree sector.

7. The ESA of claim 1, wherein the ESA is non-rotatably mounted on an airborne vehicle.

8. The ESA of claim 1, wherein said ESA operates at S-band.

9. The ESA of claim 1, wherein each subarray is a split subarray, comprising an upper subarray and a lower subarray, and said feed horn system includes means for generating a sum signal and a difference signal on receive from said upper subarray and said lower subarray.

10. An electronically scanned array (ESA) comprising:

a set of N space-fed, contiguous subarrays arranged in an annular region about a 360 degree azimuthal aperture, each subarray including an inner set of radiating elements facing inwardly, an outer-facing set of radiating elements, and a feed horn system for illuminating the inner set of radiating elements;

a set of M RF high power amplifiers, wherein M is less than N;

a commutation switch matrix for coupling outputs of the high power amplifiers to selected ones of the subarray feed horn systems to illuminate a desired sector with RF energy, said switch matrix comprising M Sway switches, wherein S=N/M, and wherein the switch matrix is controllable to select different sets of the subarray feed horn systems to illuminate a plurality of different sectors in dependence on switch settings.

11. The ESA of claim 10, wherein the ESA over said plurality of different sectors provides 360 degree coverage in an azimuth plane.

12. The ESA of claim 1, wherein the plurality of subarrays further includes, for each outer-facing radiating element, a transmit/receive (TIR) module including a phase shifter, a transmit channel and a receive channel including a low noise amplifier.

13. The ESA of claim 10, further comprising a set of transmission lines, wherein each transmission line is connected between one of S ports of one of said switches and one of said subarrays.

14. The ESA of claim 10, wherein S=3, and each sector is a 120 degree sector.

15. The ESA of claim 10, wherein the ESA is non-rotatably mounted on an airborne vehicle.

16. The ESA of claim 10, wherein said ESA operates at S-band.

17. The ESA of claim 10, wherein each subarray is a split subarray, comprising an upper subarray and a lower subarray, and said feed horn system Includes means for generating a sum signal and a difference signal on receive from said upper subarray and said lower subarray.

18. The ESA of claim 10, wherein said aperture is a circular aperture.

19. The ESA of claim 10, further comprising a time delay feed network connected through a transfer switch matrix to said set of RF amplifiers.

20. The ESA of claim 10, wherein N=24 and M=8.

21. The ESA of claim 10, wherein N=36, and M=12.

* * * * *